US011772243B2

(12) United States Patent
Li

(10) Patent No.: US 11,772,243 B2
(45) Date of Patent: Oct. 3, 2023

(54) DIRECTION-SWITCHING APPARATUS OF A RATCHET SCREWDRIVER

(71) Applicant: Yi-Min Li, Taichung (TW)

(72) Inventor: Yi-Min Li, Taichung (TW)

( * ) Notice: Subject to any disclaimer, the term of this patent is extended or adjusted under 35 U.S.C. 154(b) by 142 days.

(21) Appl. No.: 17/468,681

(22) Filed: Sep. 8, 2021

(65) Prior Publication Data

US 2023/0075834 A1 Mar. 9, 2023

(51) Int. Cl.
*B25B 15/04* (2006.01)
*B25B 23/00* (2006.01)

(52) U.S. Cl.
CPC ..... *B25B 15/04* (2013.01); *B25B 23/0035* (2013.01)

(58) Field of Classification Search
CPC ..... B25B 15/04; B25B 23/0035
USPC ..... 81/29
See application file for complete search history.

(56) References Cited

U.S. PATENT DOCUMENTS 5,404,773 A * 4/1995 Norville ..... B25B 13/462 81/59.1
6,253,646 B1 * 7/2001 Chang ..... B25B 13/462 81/59.1
6,902,047 B2 * 6/2005 Ting ..... F16D 41/18 81/63.1
8,347,760 B2 * 1/2013 Yu ..... B25B 13/463 81/59.1

* cited by examiner

*Primary Examiner* — Hadi Shakeri
(74) *Attorney, Agent, or Firm* — BRUCE STONE LLP; Joseph A. Bruce

(57) ABSTRACT

A ratchet screwdriver includes a direction-switching apparatus. The direction-switching apparatus includes a cylinder, a toothed wheel, two pawls, two springs and a connector. The cylinder includes a wheel-containing chamber in communication with two pawl-containing chambers. The toothed wheel is inserted in the wheel-containing chamber. The pawls are respectively inserted in the pawl-containing chambers. Each of the springs is connected to one of the pawls in one of the pawl-containing chambers. The connector interconnects the springs so that at least one of the springs keeps at least one of the pawls engaged with the toothed wheel to allow the cylinder to rotate the toothed wheel in at least one of two directions.

5 Claims, 9 Drawing Sheets

DIRECTION-SWITCHING APPARATUS OF A RATCHET SCREWDRIVER

BACKGROUND OF INVENTION

1. Field of Invention

The present invention relates to a ratchet screwdriver and, more particularly, to a direction-switching apparatus of a ratchet screwdriver.

2. Related Prior Art

A conventional screwdriver includes a shaft or shank formed with a flat or cruciform tip at an end and non-rotatably inserted in a handle at an opposite end. In use, the flat or cruciform tip of the shaft is inserted in a rectilinear or cruciform recess made in a threaded bolt or screw before the handle is operated to rotate the threaded bolt via the shaft. A user uses his or her hand to grasp the handle and rotate the handle in a direction, and then slackens the handle and rotates the hand relative to the handle in an opposite direction. This process is repeated to tighten or loosen the threaded bolt to a desired extent. However, this practice is troublesome and hence undesirable.

Taiwanese Patent No. 155344 discloses a ratchet screwdriver including a hollow shaft 1, a mandrel 2, a ring 3 and a cylinder 4. A spring 22 and a ball 23 are inserted in a bore 21 made in the mandrel 2 before the mandrel 2 is inserted in the hollow shaft 1. The ball 23 is biased by the spring 22. A pawl 14 is pivotably connected to the hollow shaft 1. The pawl 14 is formed with two sections. A selected one of the sections of the pawl 14 is in contact with the ball 23. The hollow shaft 1 is inserted in the cylinder 4 so that a selected one of the sections of the pawl 14 is engaged with a toothed face 41 of the cylinder 4. A pin 31 is inserted in the ring 3 and the mandrel 2. The ring 3 is operated to rotate the mandrel 2 relative to the hollow shaft 1 so that the ball 23 brings a selected one of the sections of the pawl 14 into engagement with the toothed face 41 of the cylinder 4. Thus, the cylinder 4 is allowed to rotate the hollow shaft 1 in selected one of two directions, but not in the other direction.

Taiwanese Patent No. M598209 discloses another ratchet screwdriver including a handle 11, a cylinder 30, a collar 21, a shaft 12, a toothed wheel 15, two pawls 42, a spring 46 and a ring 50. The cylinder 30 is connected to the handle 11 so that they are rotatable together. The shaft 12 includes an insert 16 at a first end and a hexagonal cavity 14 in a second end. The insert 16 is inserted in a bore 33 made in the cylinder 30 so that the shaft 12 is inserted in the cylinder 30 except for the second end. The toothed wheel 15 is coaxially formed on the shaft 12. The pawls 42 are inserted in the cylinder 30. A spring 46 is compressed between the pawls 42. A selected one of the pawls 42 is engaged with the toothed wheel 15. The ring 50 is inserted in the cylinder 30. The ring 50 extends around the shaft 12. The ring 50 includes two pushers 55 formed on a face. A selected one of the pushers 55 is engaged with a boss 44 extending from one of the pawls 42. The collar 21 includes two rods 24 formed on a face. The collar 21 extends around the shaft 12 so that the rods 24 are inserted in two cutouts 52 made in the ring 50. In use, the collar 21 is operated to rotate the ring 50 so that the ring 50 brings a selected one of the pawls 42 into engagement with the toothed wheel 15. Thus, the combination of the handle 11 with the cylinder 30 is operated to rotate the shaft 12 via one of the pawls 42 in a selected one of two opposite directions, but not in the other direction.

However, the operation of the forging ratchet screwdriver is not smooth or reliable for two reasons. Firstly, the spring 46 cannot properly bias the pawls 42 because the spring 46 is forced to extend in an arched manner, not in a rectilinear manner that is preferred. Secondly the shaft 12 does not rotate smoothly about its axis because the axis of the shaft 12 tends to pivot. The pivoting of the axis of the shaft 12 is inevitable due to inadequate length of the insert 16 and inadequate depth of the bore 33.

The present invention is therefore intended to obviate or at least alleviate the problems encountered in the prior art.

SUMMARY OF INVENTION

It is the primary objective of the present invention to provide a ratchet screwdriver with a reliable direction-switching apparatus.

To achieve the foregoing objective, the direction-switching apparatus includes a cylinder, a toothed wheel, two pawls, two springs and a connector. The cylinder includes a wheel-containing chamber in communication with two pawl-containing chambers. The toothed wheel is inserted in the wheel-containing chamber. Each of the pawls is inserted in one of the pawl-containing chambers. Each of the pawls is inserted in one of the pawl-containing chambers. Each of the springs is connected to one of the pawls. The connector interconnects the springs. Thus, at least one of the springs keeps at least one of the pawls engaged with the toothed wheel to allow the cylinder to rotate the toothed wheel in at least one of two directions.

Advantageously, the connector renders both the springs rectilinear no matter in which direction the cylinder is operable to rotate the toothed wheel in operation.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
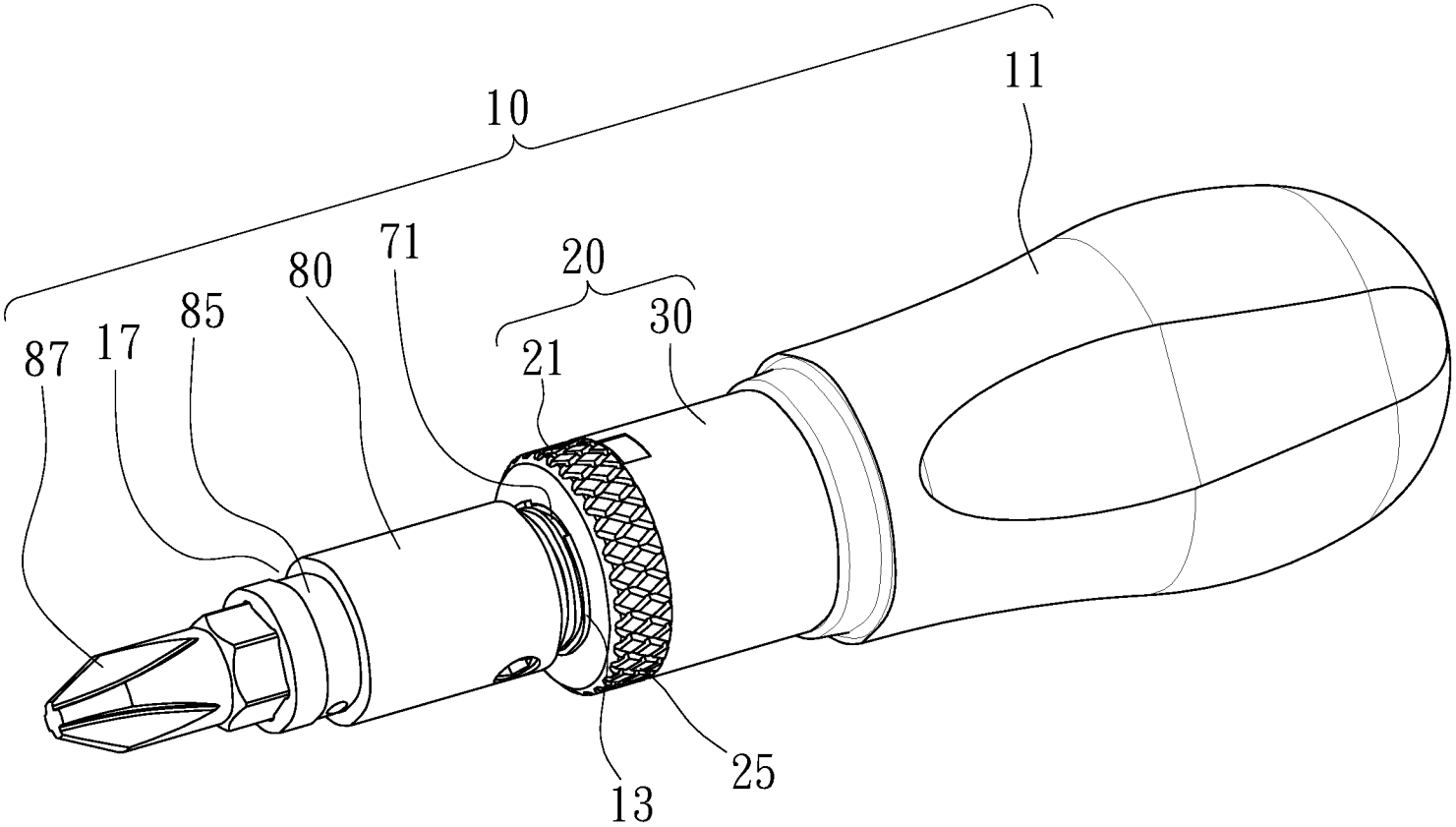
FIG. 1 is a perspective view of a ratchet screwdriver provided with a direction-switching apparatus according to the preferred embodiment of the present invention.
Figure 2:
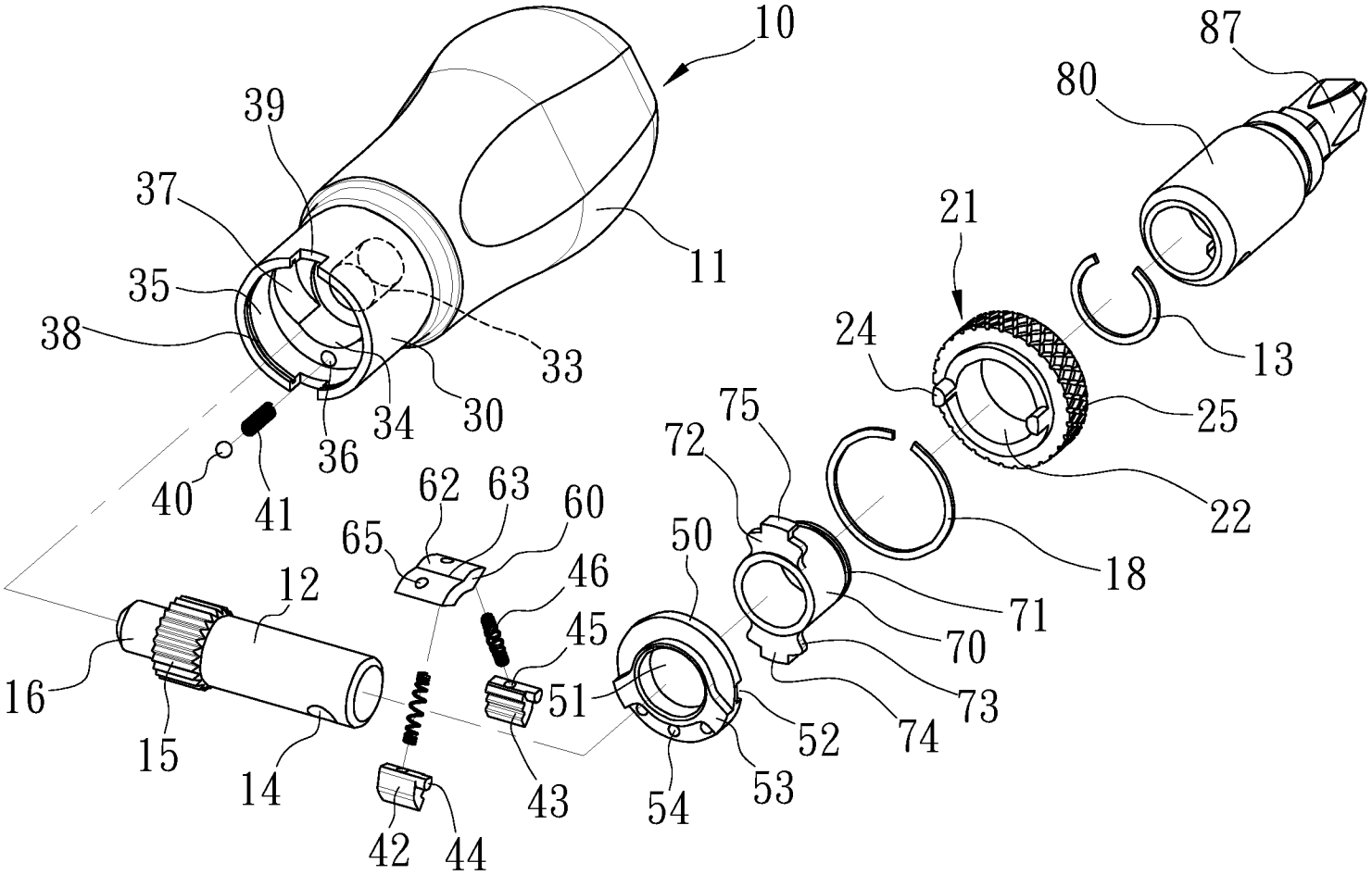
FIG. 2 is an exploded view of the ratchet screwdriver shown in FIG. 1.
Figure 3:
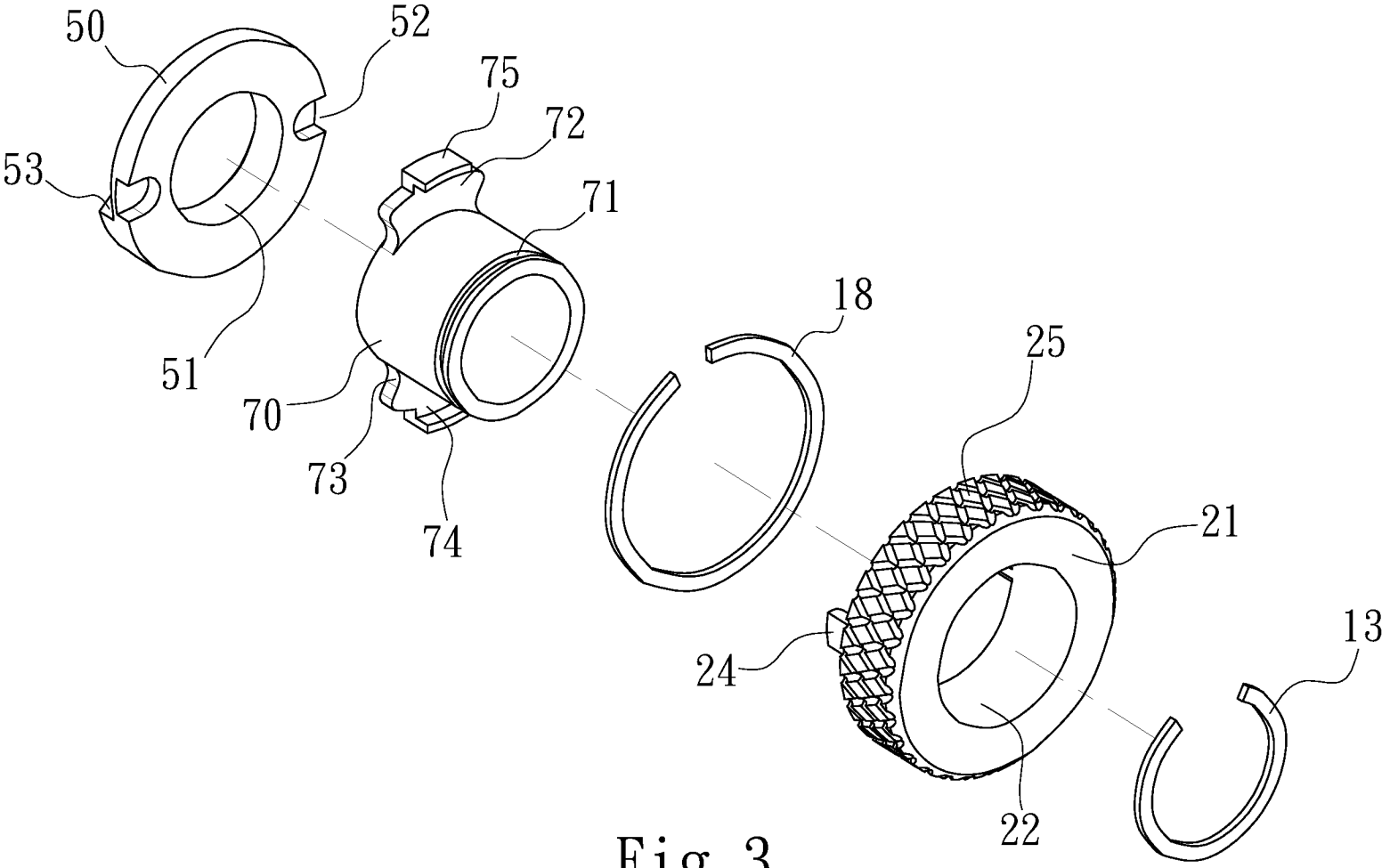
FIG. 3 is an exploded view of the direction-switching apparatus shown in FIG. 2.
Figure 4:
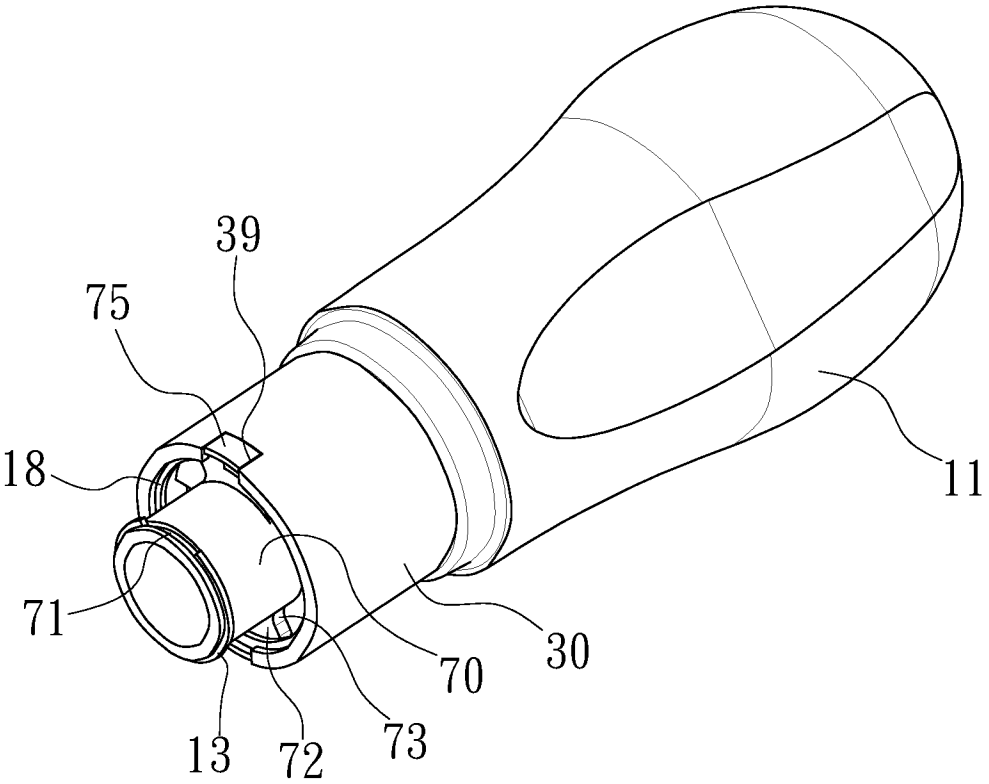
FIG. 4 is a partial view of the ratchet screwdriver shown in FIG. 1.
Figure 5:
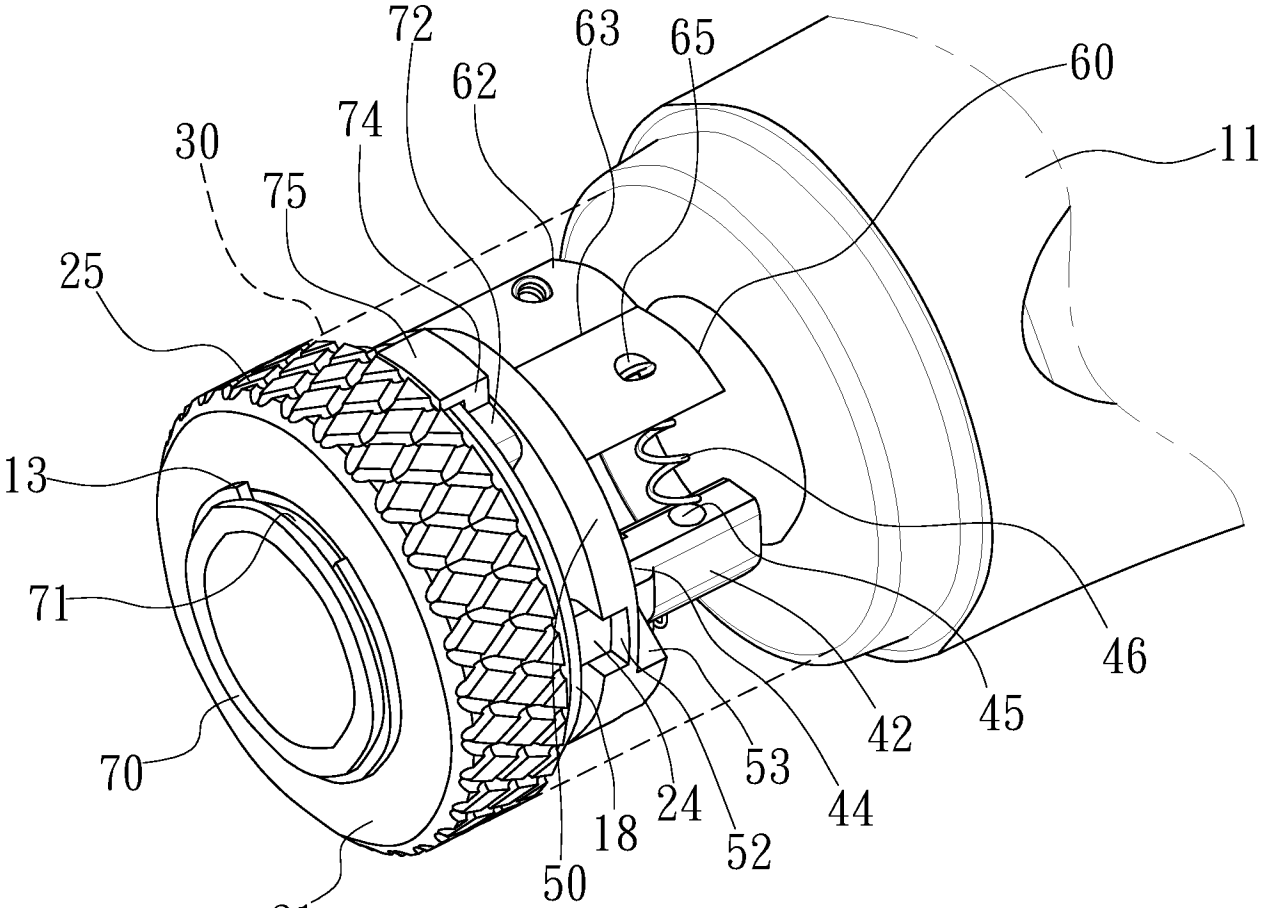
FIG. 5 is another partial view of the ratchet screwdriver depicted in FIG. 1.

Referring to FIGS. 1 to 3, a ratchet screwdriver 10 includes a handle 11, a shaft 12, a socket 80 and a bit 87, and a direction-switching apparatus 20 according to the preferred embodiment of the present invention. The direction-switching apparatus 20 includes a cylinder 30, a toothed wheel 15, two pawls 42, two springs 46, a connector 60, a collar 21, a ring 50, a bushing 70 and two C-clips 13 and 18.

The cylinder 30 includes a cavity 33, a wheel-containing chamber 34, a ring-containing chamber 35, a bore 36, two pawl-containing chambers 37, a groove 38 and two cutouts 39. The cavity 33, the wheel-containing chamber 34 and the ring-containing chamber 35 are arranged along an axis of the cylinder 30. The diameter of the ring-containing chamber 35 is larger than the diameter of the wheel-containing chamber 34. The diameter of the wheel-containing chamber 34 is larger than the diameter of the cavity 33. The wheel-containing chamber 34 is located between the pawl-containing chambers 37 in a transverse direction of the cylinder 30. Each of the pawl-containing chambers 37 is in communication with the wheel-containing chamber. The bore 36 is made in a shoulder (not numbered) formed between the wheel-containing chamber 34 and the ring-containing chamber 35. The groove 38 is an annular one made in an internal face of the cylinder 30. The cutouts 39 are made in an edge of the cylinder 30, at two ends of a diameter of the cylinder 30.

The shaft 12 includes an insert 16 at a first end and a screw hole 14 near a second end. The insert 16 is a reduce section of the shaft 12. The depth of the screw hole 14 extends in a radial direction of the shaft 12. The toothed wheel 15 is made in one piece with the shaft 12. The toothed wheel 15 is located between the insert 16 and the screw hole 14.

The pawls 42 are mirror images of each other. Each of the pawls 42 includes three substantially rectangular faces between two substantially triangular faces. A toothed face 43 is formed on the first substantially rectangular. A bore 45 is made in the second substantially rectangular face. The third substantially rectangular face is a convex one. A boss 44 extends from one of the substantially triangular faces.

The connector 60 includes an internal face 61, an external face 62, two ends 64 and two apertures 65. The internal face 61 is a concave one. The external face 62 includes a dent 63 between two convex portions. Each of the apertures 65 extends to one of the convex portions of the external face 62 from one of the ends 64.

The ring 50 is a flat element including a front face and a rear face. The ring 50 includes a central opening 51, two recesses 52 made in the front face, two pushers 53 formed on the rear face, and three recesses 54 made in the rear face. The opening 51 is located between the recesses 52. The pushers 53 are named because each of them includes a concave portion. However, the pushers 53 can be shaped and named otherwise as long as they can be used to abut against the bosses 44 of the pawls 42. The recesses 54 are located between the pushers 53. For briefness of the description, the recesses 54 will be referred to as the "middle recess 54" and the "lateral recesses 54."

The collar 21 is formed with a central opening 22, a reduced section 23, two rods 24 and an anti-skid face 25. The reduced section 23 extends from a rear face of the collar 21. Two rods 24 extend from an edge of the reduced section 23. The rods 24 are shaped and sized in compliance with the recesses 52. The anti-skid face 25 is formed on the periphery of the collar 21.

The bushing 70 includes a groove 71 and two fins 72. The groove 71 is an annular groove extending in an external face of the bushing 70. The fins 72 extend along a diameter of the bushing 70, opposite to each other. Each of the fins 72 includes a tenon 74 extending from an end edge extending between two lateral edges 73 and an arched wall 75 extending from the tenon 74 in a longitudinal direction of the bushing 70.

Figure 6:
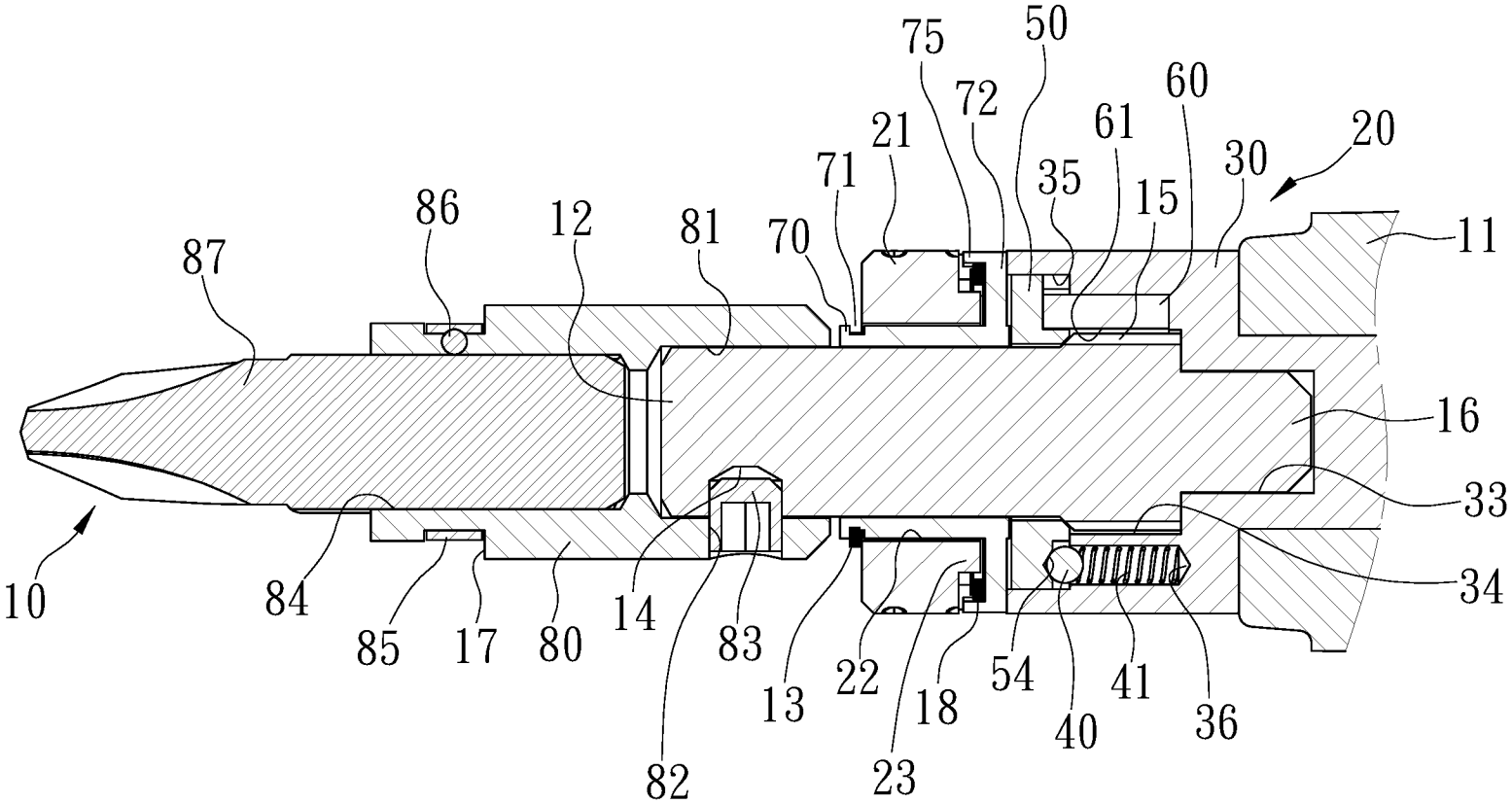
FIG. 6 is a partial and cross-sectional view of the direction-switching apparatus shown in FIG. 2.

Referring to FIGS. 1, 2 and 6, the socket 80 includes two chambers 81 and 84 and an aperture 82. The chamber 81 is made in a front section of the socket 80. The chamber 84 is made in a rear section of the socket 80. The chamber 81 is in communication with the chamber 84, with annular spacer (not numbered) formed between the chambers 81 and 84. In another embodiment, the chamber 81 is separated from the chamber 84. The aperture 82 extends along a radius of the socket 80. The aperture 82 is in communication with the chamber 81.

The socket 80 further includes an orifice (not numbered) and a groove 17. The orifice of the socket 80 is in communication with the chamber 84. The groove 17 is an annular groove extending in an external face of the socket 80. The groove 17 is in communication with the orifice of the socket 80.

In assembly, the cylinder 30 is connected to the handle 11 so that they are not movable relative to each other. The handle 11 can be provided on the cylinder 30 by injection molding of plastics.

The insert 16 is inserted in the cavity 33 so that the toothed wheel 15 is located in the wheel-containing chamber 34.

Figure 7:
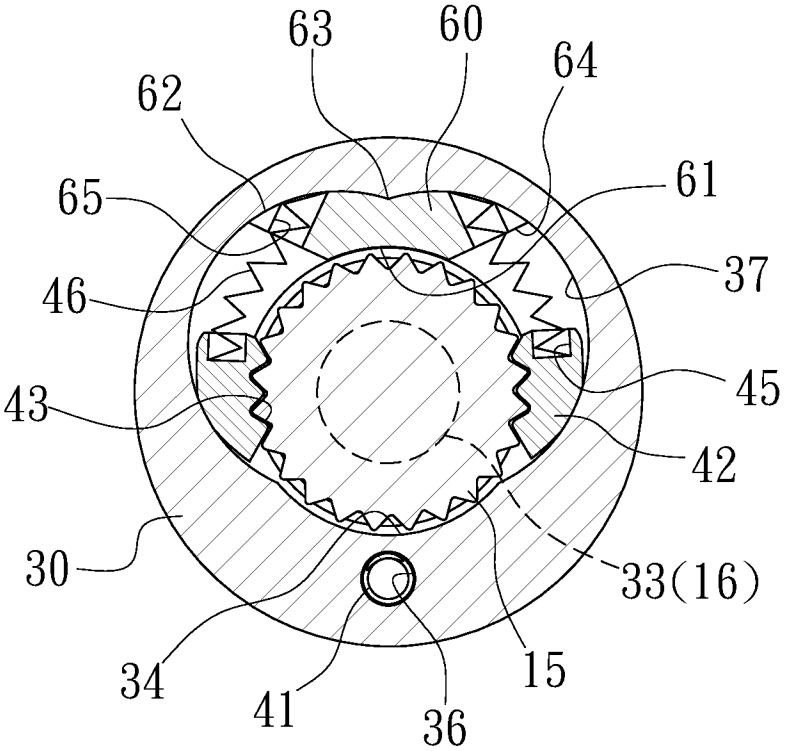
FIG. 7 is a cross-sectional view of the direction-switching apparatus shown in FIG. 6.

Referring to FIG. 7 in addition, each of the springs 46 includes an end inserted in the bore 45 of one of the pawls 42 and another end inserted in one of the apertures 65 of the connector 60. The pawls 42 are inserted in the pawl-containing chambers 37. Each of the springs 46 keeps the toothed portion 43 of one of the pawls 42 in engagement with the toothed wheel 15. The connector 60 is located in the wheel-containing chamber 34. The connector 60 allows the springs 46 to extend in a substantially rectilinear path in operation.

A spring 41 and a ball 40 are inserted in the bore 36 of the cylinder 30 before the ring 50 is inserted in the ring-containing chamber 35. A portion of the ball 40 is insertable in a selected one of the recesses 54 to keep the ring 50 in a selected one of three positions or angles relative to the cylinder 30.

A portion of the bushing 70 is inserted in the ring-containing chamber 35. The fins 72 abut against the wall of the ring-containing chamber 35 (or the internal face of the cylinder 30) to keep the bushing 70 and hence the shaft 12 coaxial with the cylinder 30. The tenons 74 of the bushing 70 are inserted in the cutouts 39 of the cylinder 30 so that the bushing 70 is not rotatable relative to the cylinder 30. Each of the arched walls 75 includes an external face in flush with an external face of the cylinder 30. The shaft 12 is inserted in the bushing 70 so that the former is supported by the latter. The lateral edges 73 are used for contact with the rods 24 to limit the rotation of the collar 21 relative to the cylinder 30.

A ball 86 is inserted in the orifice of the socket 80 before a ferrule 85 is inserted in the groove 17. Thus, the ferrule 85 abuts against a portion of the ball 86 so that an opposite portion of the ball 86 enters the chamber 84.

The C-clip 18 is inserted in the groove 38. The C-clip 18 abuts against the fins 72 of the bushing 70, thereby keeping the fins 72 in the ring-containing chamber 35 of the cylinder 30. Hence, the fins 72 abut against the ring 50, thereby keeping the ring 50 in the ring-containing chamber 35.

The collar 21 is located around and on the bushing 70. The C-clip 13 is inserted in the groove 71. The C-clip 13 abuts against the collar 21. Thus, the collar 21 is kept on the bushing 70.

The rods 24 of the collar 21 are inserted in the recesses 52 of the ring 50. Thus, the collar 21 is operable to rotate the ring 50 so that a selected one of the pushers 53 moves one of the pawls 42 by the boss 44.

The socket 80 is located around and on the shaft 12, i.e., the shaft 12 is inserted in the socket 80. A screw 83 is inserted in the screw hole 14 of the shaft 12 via the aperture 82 of the socket 80, thereby keeping the socket 80 on the shaft 12. In another embodiment, the screw 83 can be replaced with a pin fitted in a bore (instead of the screw hole 14) made in the shaft 12 via the aperture 82.

Figure 8:
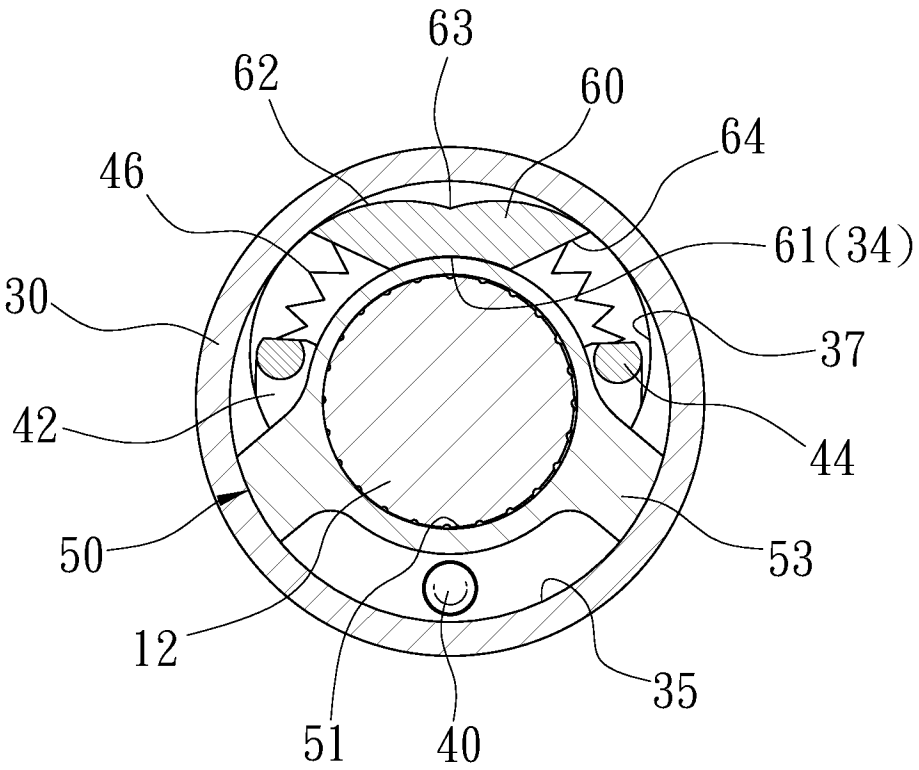
FIG. 8 is a cross-sectional view of the direction-switching apparatus in another position than shown in FIG. 7.

Referring to FIGS. 7 and 8, the ball 40 is inserted in the middle recess 54 to keep both of the pawls 42 engaged with the tooled wheel 15. Thus, the cylinder 30 is operable to rotate the shaft 12 clockwise and counterclockwise.

Figure 9:
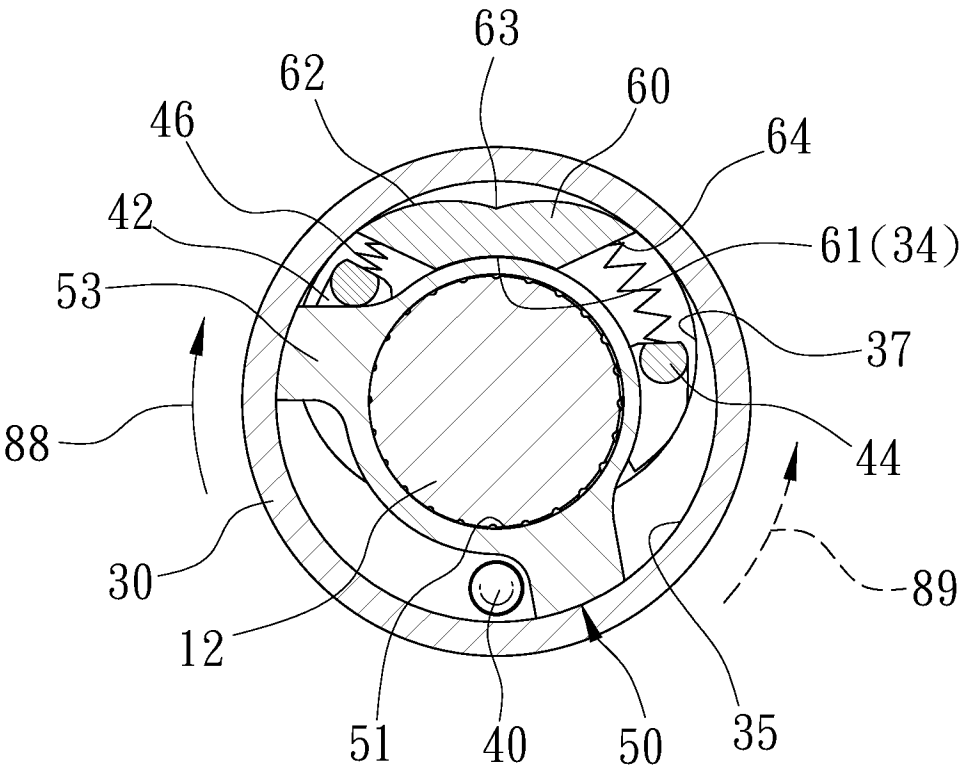
FIG. 9 is a cross-sectional view of the direction-switching apparatus in another position than shown in FIG. 8.

Referring to FIG. 9, the ball 40 is inserted in a selected one of the lateral recesses 54 so that a selected one of the pushers 53 pushes the boss 44 of one of the pawls 42 and hence keeps the other pawl 42 engaged with the toothed wheel 15. Thus, for example, the cylinder 30 is operable to rotate the shaft 12 clockwise as indicated by an arrow head 88, but not counterclockwise as indicated by an arrow head 89.

The use of the connector 60 to interconnect the springs 46 is advantageous because the connector 60 renders both the springs 46 rectilinear in operation.

Moreover, the use of the bushing 70 to support the shaft 12 is advantageous since the bushing 70 keeps the shaft 12 smoothly rotatable in operation.

The present invention has been described via the illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A direction-switching apparatus for a ratchet screwdriver comprising:

a cylinder comprising a wheel-containing chamber and two pawl-containing chambers in communication with the wheel-containing chamber;

a toothed wheel inserted in the wheel-containing chamber;

two pawls respectively inserted in the pawl-containing chambers;

two springs each of which is connected to one of the pawls in one of the pawl-containing chambers; and a connector for interconnecting the springs so that at least one of the springs keeps at least one of the pawls engaged with the toothed wheel to allow the cylinder to rotate the toothed wheel in at least one of two directions, wherein the connector comprises two ends and an external face extending between the ends, wherein each of the ends abuts against an end of one of the springs, wherein the external face comprises two convex portions and a dent between the convex portions.

2. The direction-switching apparatus for a ratchet screwdriver according to claim 1, wherein the connector comprises two apertures for respectively receiving the springs.

3. The direction-switching apparatus for a ratchet screwdriver according to claim 2, wherein each of the pawls comprises a bore for receiving a portion of one of the springs.

4. The direction-switching apparatus for a ratchet screwdriver according to claim 1, wherein each of the springs is a compression spring.

5. The direction-switching apparatus for a ratchet screwdriver according to claim 1, each of the pawls comprises a toothed portion for engagement with the toothed wheel.

* * * * *